US007516606B2

(12) United States Patent
Schaeffler

(10) Patent No.: US 7,516,606 B2
(45) Date of Patent: Apr. 14, 2009

(54) PROCESS FOR OPTIMIZING THE PRODUCTION PERFORMANCE OF A SPINNING MACHINE

(75) Inventor: Gernot Schaeffler, Waeschenbeuren (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 11/666,730

(22) PCT Filed: Oct. 28, 2005

(86) PCT No.: PCT/EP2005/011534

§ 371 (c)(1),
(2), (4) Date: May 2, 2007

(87) PCT Pub. No.: WO2006/048186

PCT Pub. Date: May 11, 2006

(65) Prior Publication Data

US 2008/0041029 A1 Feb. 21, 2008

(30) Foreign Application Priority Data

Nov. 2, 2004 (DE) ..... 10 2004 053 505

(51) Int. Cl.
*D01H 13/26* (2006.01)

(52) U.S. Cl. ..... 57/264; 57/350

(58) Field of Classification Search ..... 57/264, 57/315, 350

See application file for complete search history.

(56) References Cited

U.S. PATENT DOCUMENTS

| | | | | |
|---|---|---|---|---|
| 4,083,172 | A * | 4/1978 | Norris et al. | 57/293 |
| 4,821,503 | A * | 4/1989 | Stalder et al. | 57/264 |
| 5,048,281 | A | 9/1991 | Dallmann et al. | |
| 5,420,802 | A * | 5/1995 | Nevel et al. | 702/43 |
| 5,901,544 | A * | 5/1999 | McNeill | 57/341 |
| 2002/0124545 | A1 | 9/2002 | Griesshammer et al. | |

FOREIGN PATENT DOCUMENTS

| | | |
|---|---|---|
| DE | 38 36 481 A1 | 5/1990 |
| DE | 101 53 457 A1 | 5/2003 |
| EP | 1 205 588 B1 | 5/2002 |
| SU | 1030432 A | 7/1983 |

OTHER PUBLICATIONS

International Search Report dated Aug. 28, 2006 with English translation of the pertinent portion (Ten (10) pages).

* cited by examiner

*Primary Examiner*—Shaun R Hurley
(74) *Attorney, Agent, or Firm*—Crowell & Moring LLP

(57) ABSTRACT

A process is provided for optimizing the production performance of a spinning machine. Each individual spinning position is separately monitored in relation to the number of end breaks and is adjusted to an optimal production speed. When this process is applied to an air jet spinning machine, the compressed air fed to the spinning positions is adjusted depending on the respective production speed.

2 Claims, 1 Drawing Sheet

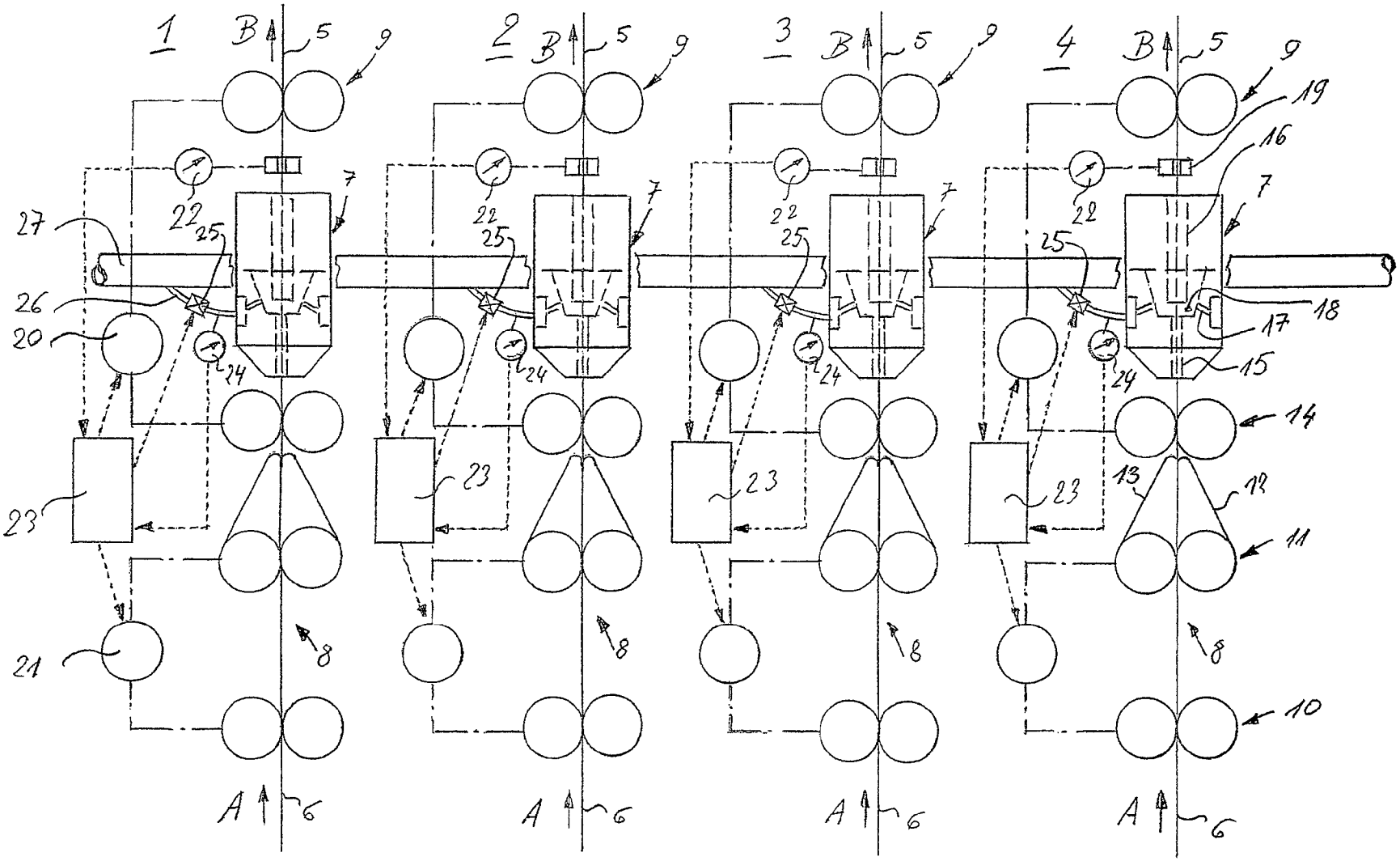
1
2
3
4
A
B
5
6
7
8
9
10
11
12
13
14
15
16
17
18
19
20
21
22
23
24
25
26
27

PROCESS FOR OPTIMIZING THE PRODUCTION PERFORMANCE OF A SPINNING MACHINE

BACKGROUND AND SUMMARY OF THE INVENTION

The present invention relates to a process for optimizing the production performance of a spinning machine, in that the production speed is reduced in the case of an increase in the number of end breaks, while in the case of a decreasing number of end breaks, the production speed is increased.

A process of this type is known from Soviet Union patent application 10 30 432. According to this patent application, the machine speed is adapted to the rate of end breaks. The process is utilized on a false twist spinning machine.

In practice, however, it has been shown that, in regard to the number of end breaks, the individual spinning positions of a spinning machine can behave in very different ways. If the process is oriented towards the worst spinning position, as is the case in the known process, a state is reached where few end breaks occur, but where the production performance of the spinning machine overall is not optimized.

It is an object of the present invention to duly take into consideration the different end break rates at the individual spinning positions for the purpose of optimizing the production performance of the machine.

This object has been achieved in accordance with the present invention in that each individual spinning position of the spinning machine is separately monitored with regard to the number of end breaks and adjusted to an optimized production speed.

Such individual adjustment of the individual spinning positions depending on the number of end breaks assumes, of course, that each of the spinning positions can be driven separately. This means that, for the feed of the fiber material, the driving of twisting devices as well as the draw-off and the winding up of the spun thread, correspondingly regulatable individual drives must be on hand. Despite the increased technical complexity in comparison to the above mentioned prior art, the great advantage arises in that the entire spinning machine does not have to be reduced in speed because of one single "bad" spinning position, but rather each individual spinning position operates at an optimized spinning speed, which ultimately results in an optimized production performance of the entire machine.

When adjusting the production speed, it is practical when the level of the spinning twist is accordingly adapted thereto. When applied to an air jet spinning machine, this means that the compressed air fed to the spinning positions is adjusted with regard to the spinning pressure depending on the respective production speed. The measuring of the static pressure at the individual spinning positions can be useful for this purpose. This has the added advantage in that, even in the case of a slight blockage of the compressed air fed to the individual spinning positions, the spinning process operates in spite of this with the correct spinning twist. A controller, including an evaluator, is arranged to each individual spinning position for the adjustment of the production speed.

These and further objects, features and advantages of the present invention will become more readily apparent from the following detailed description thereof when taken in conjunction with the accompanying schematic drawing.

BRIEF DESCRIPTION OF THE DRAWING

The sole FIGURE is a schematic diagram of an air jet spinning machine including devices for adjusting an optimized production speed.

DETAILED DESCRIPTION OF THE DRAWING

An air jet spinning machine has a number of spinning positions, of which only four spinning positions 1, 2, 3, and 4 are shown in FIG. 1. Each spinning position 1, 2 . . . serves to spin a thread 5 from a staple fiber strand 6 and includes as essential components an air jet aggregate 7, a drafting device 8 advantageously designed as a three-cylinder drafting device, as well as a draw-off roller pair 9 and a winding up device (not shown), to which the drawn off thread 5 is fed in draw-off direction B.

As can be seen in the example of the spinning position 4, each drafting device 8 includes an entry roller pair 10, to which the staple fiber strand 6 to be drafted is fed in feed direction A, an apron roller pair 11, which is looped by guiding aprons 12 and 13, and also an exit roller pair 14, at which the drafting zone of the drafting device 8 ends. The staple fiber strand 6 is drafted in the known way in the drafting device 8 to the desired degree of fineness.

Each air jet aggregate 7 has a feeding channel 15, to which the drafted but still twist-free staple fiber strand 6 is fed for receiving a spinning twist. The air jet aggregate 7 further includes a thread draw-off channel 16 for the spun thread 5. Compressed air nozzles 17 are arranged in the interior of the air jet aggregate 7, whose exit openings lead into a vortex chamber 18, where the actual spinning twist is imparted.

Between the air jet aggregate 7 and the draw-off roller pair 9, an end break detector 19 is arranged, which causes the relevant spinning position 1, 2 . . . to come to a standstill in the case of an end break.

As can be seen in the example of the spinning position 1, a joint first drive motor 20 is provided for driving the exit roller pair 14 and also the draw-off roller pair 9 of each individual spinning position 1, 2 . . . , so that the roller pairs 14 and 9 are always driven together, at however slightly different speeds. This permits a desired tension of the thread 5. The speed of the drive motor 20 is adjustable.

The entry roller pair 10 and the apron roller pair 11 of the drafting device 8 are each driven by a joint second drive motor 21. In this case, the apron roller pair 11 must run significantly faster than the entry roller pair 10, as in this area the pre-draft of the staple fiber strand 6 takes place. The speed of the drive motor 21 is also adjustable.

Due to various causes, for example an end break, the normal spinning operation is interrupted, which reduces the production performance at the respective spinning position 1, 2 . . . . In order to prevent the continued feed of staple fiber strand 6 to the drafting device 8 in the case of an end break, it is provided, controlled by the end break detector 19, that the drive motors 20 and 21 are then shut down. The compressed air feed to the compressed air nozzles 17 is also shut off at the spinning position 1, 2 . . . , thus requiring maintenance.

According to the present invention, the production performance of the air jet spinning machine is to be optimized, in that each individual spinning position 1, 2 . . . runs at an optimized speed. For this purpose, each individual spinning position 1, 2 . . . is separately monitored with regard to the number of end breaks and adjusted to an optimized production speed, which is reduced in the case of a high rate of end breaks, and increased in the case of a relatively low rate of end breaks.

In order to establish at which spinning position 1, 2 . . . more end breaks and at which spinning position 1, 2 . . . less end breaks are occurring, an end break counter 22 is present at each spinning position 1, 2 . . . . The end break counter 22 is connected directly with the respective end break detector 19. Each spinning position 1, 2 . . . includes a regulator 23, which comprises, amongst others, an evaluator for the number of the registered end breaks. The regulator 23 is capable of adjusting the drive motors 20 and 21 to an optimized production speed, at which the number of end breaks does not exceed a predetermined amount.

In order that the level of imparted spinning twist remains constant in relation to the delivery speed in spite of the differing production speeds at the individual spinning positions 1, 2 . . . , it is provided that at each individual spinning position 1, 2 . . . , the fed compressed air is also adjustable depending on the respective production speed. Each spinning position 1, 2 . . . is connected via a connection 26 with a compressed air conduit 27. At each connection 26, a compressed air sensor 24 and a choke valve 25 can, for example, be provided, so that the choke valve 25 can be activated via the regulator 23 and the spinning pressure can be adjusted.

The invention claimed is:

1. A process for optimizing production performance of a spinning machine having a plurality of spinning positions, each spinning position being equipped with a yarn breakage detector, individually controllable drive elements and individually controllable twisting elements, in which spinning machine production speed is reduced in a case of an increase in the number of end breaks, and is increased in the case of a decreasing number of end breaks, the process comprising the acts of:

monitoring each individual spinning position of the spinning machine separately with regard to the number of end breaks; and adjusting each individual spinning position to an optimized production speed, wherein when the production speed is adjusted, the level of the imparted spinning twist is accordingly adapted thereto, and control of the amount of imparted spinning twist is performed by a controllable choke valve.

2. The process according to claim 1, wherein in the case of application to an air jet spinning machine, the compressed air fed to the spinning positions is adjusted depending on the respective production speed.

* * * * *